US008068058B2

(12) United States Patent
Sullivan

(10) Patent No.: US 8,068,058 B2
(45) Date of Patent: Nov. 29, 2011

(54) ANTENNA ASSEMBLY WITH CONNECTORS HAVING AN INTERNAL CONDUCTIVE CHANNEL

(75) Inventor: Jonathan L. Sullivan, Lincoln, NE (US)

(73) Assignee: Laird Technologies, Inc., Chesterfield, MO (US)

( * ) Notice: Subject to any disclaimer, the term of this patent is extended or adjusted under 35 U.S.C. 154(b) by 643 days.

(21) Appl. No.: 12/166,598

(22) Filed: Jul. 2, 2008

(65) Prior Publication Data

US 2009/0009403 A1 Jan. 8, 2009

Related U.S. Application Data

(60) Provisional application No. 60/948,291, filed on Jul. 6, 2007.

(51) Int. Cl.
*H01Q 9/04* (2006.01)
*H01Q 1/38* (2006.01)

(52) U.S. Cl. ..... 343/700 MS; 343/702; 343/841; 343/895; 343/906

(58) Field of Classification Search ..... 343/700 MS, 343/702, 841, 873, 895, 906
See application file for complete search history.

(56) References Cited

U.S. PATENT DOCUMENTS

| | | | | |
|---|---|---|---|---|
| 5,539,417 | A | 7/1996 | Terry et al. | |
| 6,271,794 | B1 * | 8/2001 | Geeraert | 343/700 MS |
| 6,424,315 | B1 * | 7/2002 | Glenn et al. | 343/895 |
| 6,473,045 | B1 | 10/2002 | Duquerroy et al. | |
| 6,486,837 | B2 * | 11/2002 | Spiegel et al. | 343/702 |
| 6,512,491 | B2 | 1/2003 | Kanayama et al. | |
| 6,664,930 | B2 | 12/2003 | Wen et al. | |
| 6,683,577 | B1 | 1/2004 | Yang et al. | |
| 6,940,459 | B2 * | 9/2005 | Sullivan et al. | 343/702 |
| 7,486,243 | B2 * | 2/2009 | Wulff et al. | 343/702 |

* cited by examiner

*Primary Examiner* — Douglas W Owens
*Assistant Examiner* — Chuc Tran
(74) *Attorney, Agent, or Firm* — Harness, Dickey & Pierce, P.L.C.

(57) ABSTRACT

The present invention provides an antenna with an integral electrical connection to a printed circuit board. The electrical connection is accomplished by providing a connection beam from a conductive layer to the circuit board. The connection beam is provided with a channel extending through the connection beam, such as a channel through the geometric center of the beam, and the channel is plated. The connection beam terminates with a contact point. The beam is deflectable to provide contact force.

17 Claims, 5 Drawing Sheets

ANTENNA ASSEMBLY WITH CONNECTORS HAVING AN INTERNAL CONDUCTIVE CHANNEL

CLAIM OF PRIORITY UNDER 35, U.S.C. §119

The present Application for Patent claims the benefit of U.S. patent application Ser. No. 60/948,291, filed Jul. 6, 2007, the disclosure of which is incorporated herein by reference.

CLAIM OF PRIORITY UNDER 35, U.S.C. §120

None.

REFERENCE TO CO-PENDING APPLICATIONS FOR PATENT

The present Application for Patent is related to U.S. Pat. No. 6,940,459, titled ANTENNA ASSEMBLY WITH ELECTRICAL CONNECTORS, issued Sep. 6, 2005, the disclosure of which is incorporated herein by reference as if set out in full.

BACKGROUND

1. Field

The technology of present application relates generally to wireless communication devices, and more specifically to electrical connections for internal antenna assemblies.

2. Background

Wireless devices use a variety of different types of antennas. The styles can be classified in two generic categories: external and internal. External antennas are generally more efficient than internal antennas. But internal antennas are less prone to damage and usually more aesthetically pleasing. The technology of the present application generally relates to internal antennas and can be used with single or multi-band antennas.

Internal antenna can be made using a number of different methodologies. One method of making internal antennas is a stamped metal or embossing technique. The stamped metal technique uses thin metal that is stamped and formed into the size and shape needed to form the needed radiator design. This piece of metal is then connected to a non-conductive carriage to form the antenna assembly. Another technique used to manufacture antennas is the flexible film approach. This technique uses a thin layer of conductive material such as copper attached to a think non-conductive substrate such as Capton or Mylar. The substrate has a thin layer of adhesive on the back surface. To form the radiator geometry, the copper that is not needed is removed by using conventional printed circuit board manufacturing methods. This flexible film is then attached to a rigid structure such as the antenna carriage or the handset housing wall. Yet another method of manufacturing antennas is the multi-shot injection molded, selectively plated technique. The multi-shot technique usually has an injection molded base of non platable plastic with a platable plastic injection molded onto selective portions of the base. The platable plastic is then metalized using one of many various techniques, such as, for example, electroplating. Another method of to manufacture antennas includes a laser direct structure methodology. The laser direct structure methodology uses a plastic carrier that can be activated by a laser such that a portion of the carrier in the radiator pattern is platable. The activated portion of the laser direct structure plastic is than plated using a conventional plating technique, such as electroplating.

Against this background, improved internal antennas are still desirous.

SUMMARY

Embodiments disclosed herein address the above stated needs by providing an antenna assembly including a carriage layer and a connector integrated into the carriage layer. The connector having a channel with a conductive layer coupled to a surface of the channel to form an electrical connection between the antenna and a radio frequency power source.

DETAILED DESCRIPTION

The technology of the present application will now be described with reference to FIGS. 1-7. While the technology is described in relation to a cellular telephone, other wireless devices could benefit from the technology. Other devices include, without limitation, computers, electronic games, servers, MP-3, players, wireless television, digital video disc players, personal digital assistants, radios, two-ways radios, or the like. Moreover, the technology of the present application will be explained with reference to exemplary embodiments. The word "exemplary" is used herein to mean "serving as an example, instance, or illustration." Any embodiment described herein as "exemplary" is not necessarily to be construed as preferred or advantageous over other embodiments. Moreover, unless otherwise specified, the embodiments referred to herein should be considered exemplary.

Figure 1:
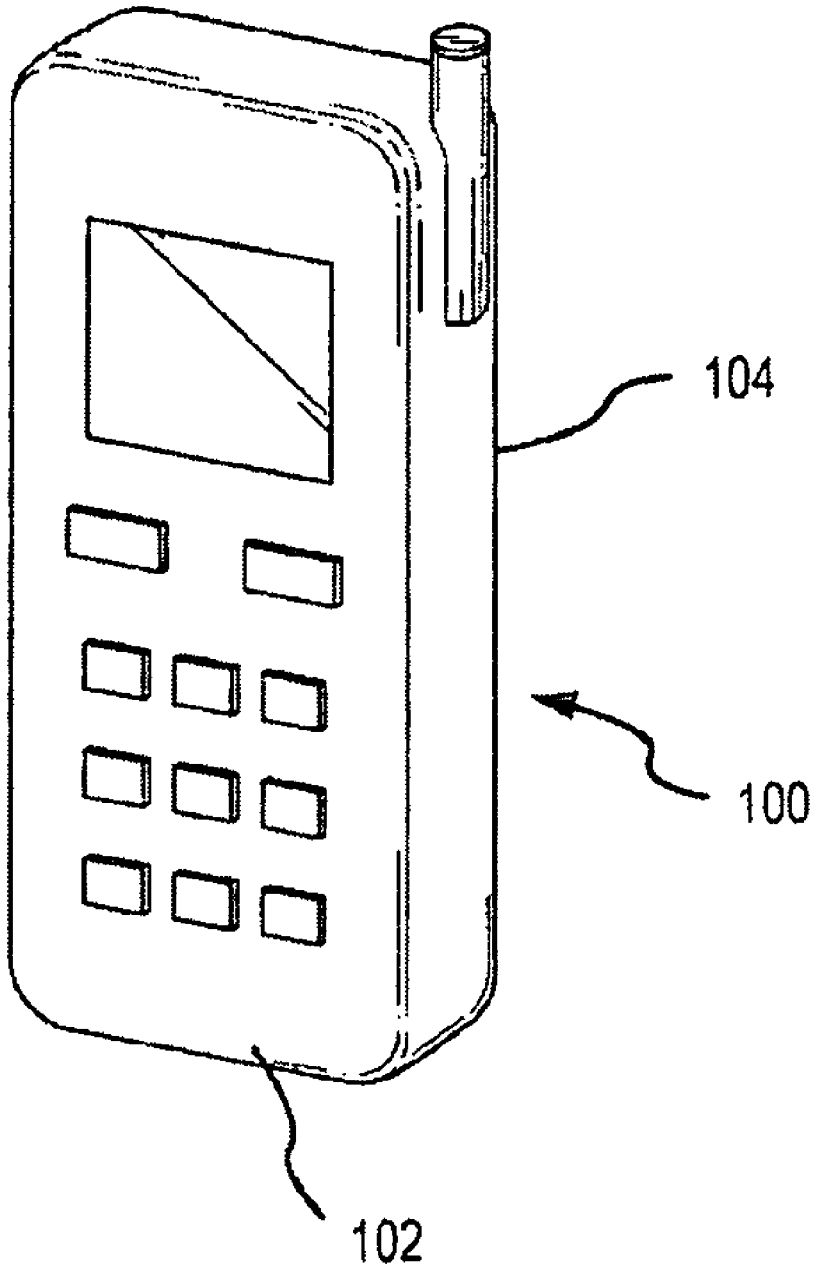
FIG. 1 is a is a front perspective view of a cellular telephone having an antenna consistent with the present invention.
Figure 2:
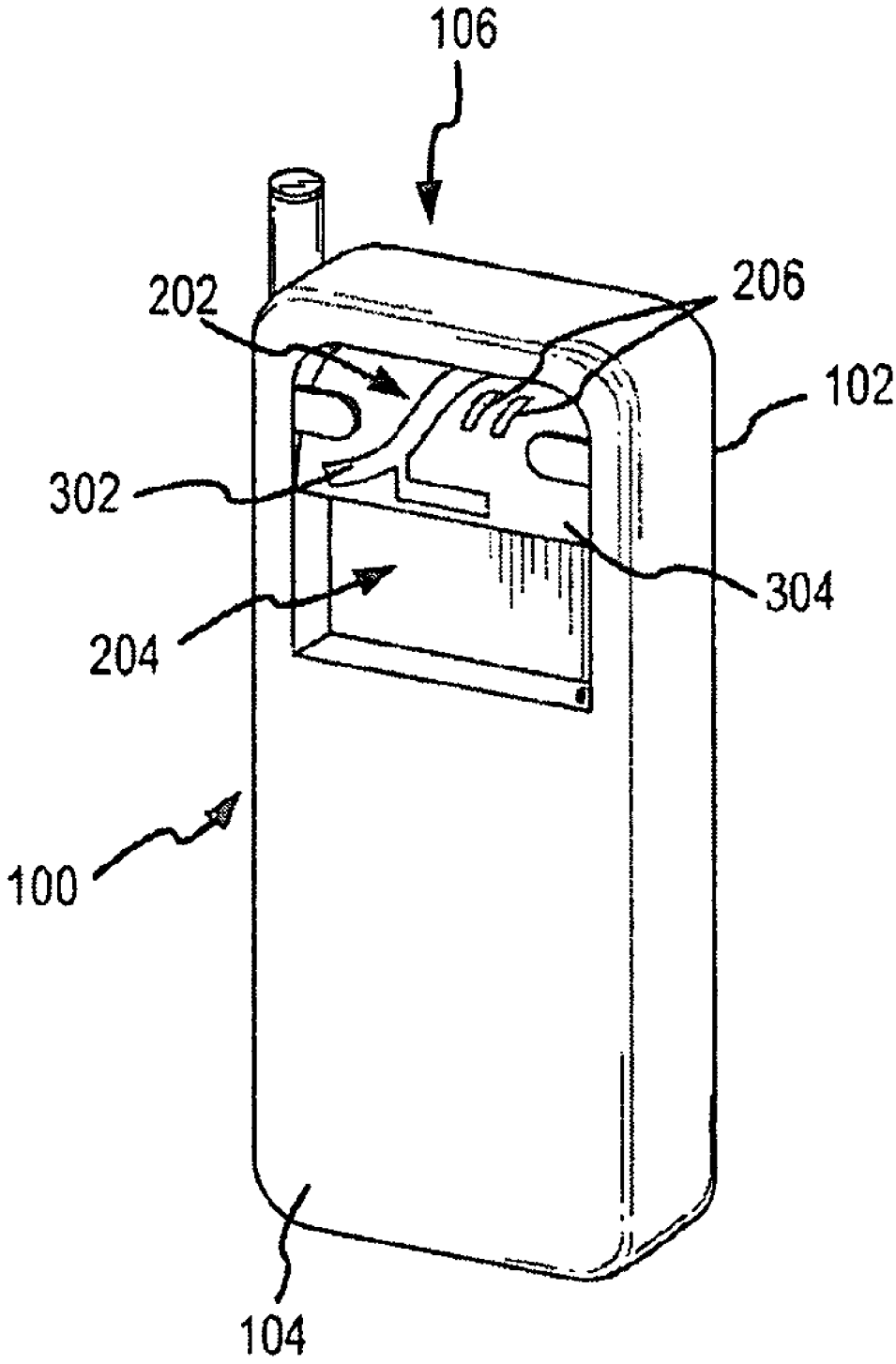
FIG. 2 is a is a back perspective view the cellular telephone having a cutaway section showing a perspective view of an antenna consistent with the present invention.

Referring to FIG. 1, a wireless device 100 is shown. Wireless device 100 is shown having a front side 102 and backside 104. Wireless device 100 is shown with an external antenna (which is not specifically labeled). FIG. 2 shows wireless device 100 with a cutaway portion 106 in backside 104 exposing internal antenna 202 and a printed circuit board 204. While shown with a particular configuration, the configuration of internal antenna 202 and printed circuit board 204 is largely determined by wireless device 100 and the particular placement in this case is exemplary. Internal antenna 202 has ports 206, which will be explained further below. Ports 206 provide connection points between internal antenna 202 and feed and ground points on printed circuit board 204. Internal antenna 202 comprises a carrier 302 and a plated surface 304. Plated surface 304 may be formed using any conventional means identified above. Except in the context of the technology of the present application, methods and means to plate surface 304 will not be further described herein.

Figure 3:
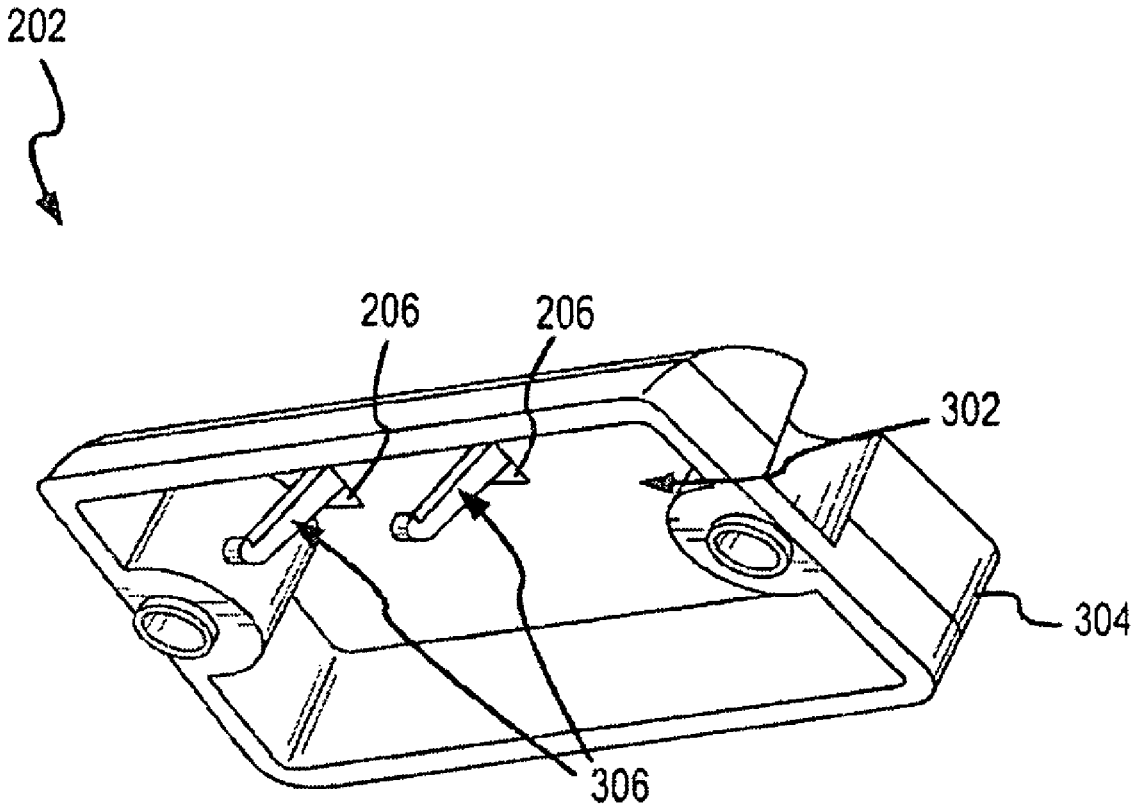
FIG. 3 is a is a perspective view of an antenna consistent with the present invention.

Referring to FIG. 3, internal antenna 202 is shown removed from wireless device 100. Antenna 202 includes a carrier 302 and a plated surface 304 on carrier 302. Carrier 302 also may be referred to as a carriage or base for antenna 202. Plated surface 304 may be plated using any conventional means, such as laser direct structuring and plating, metal stamping, two-shot molding selectively plating (which would require a layer of platable plastic not specifically shown). Extending from ports 206 are molded connectors 306. Molded connectors 306 are typically molded with carrier 302 during the same injection molding process and generally are formed of the same material including, for example, laser direct structuring material, one or both of the plastics from the molding process, or the like.

Figure 4:
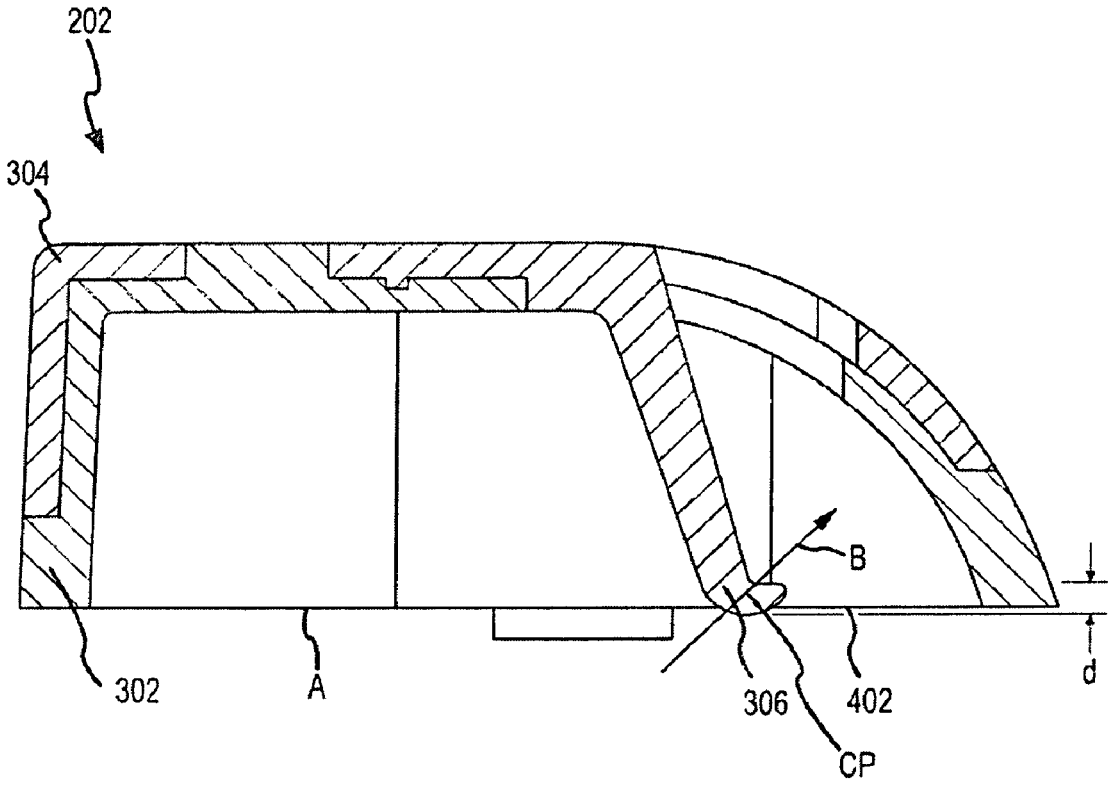
FIG. 4 is a cross sectional view of the antenna of FIG. 3.

FIG. 4 show a cross sectional view of antenna 202 and a surface 402 on which antenna 202 may be mounted. As shown in FIG. 2, antenna 202 is mounted on a printed circuit board 204 in this example, but antenna 202 may be mounted on any surface 402 including, for example, a housing of wireless device 100 (such as front or back side 102 and 104), a printed circuit board 204, or the like. Molded connectors 306 are shown un-deflected in FIG. 4 such that a contact point (CP) of molded connectors extends slightly below a plane A defined by surface 402. When mounted on surface 402, however, molded connectors 306 deflect in a direction shown by arrow B to provide a seating force on the radio frequency power contact and ground contact.

Figure 5:
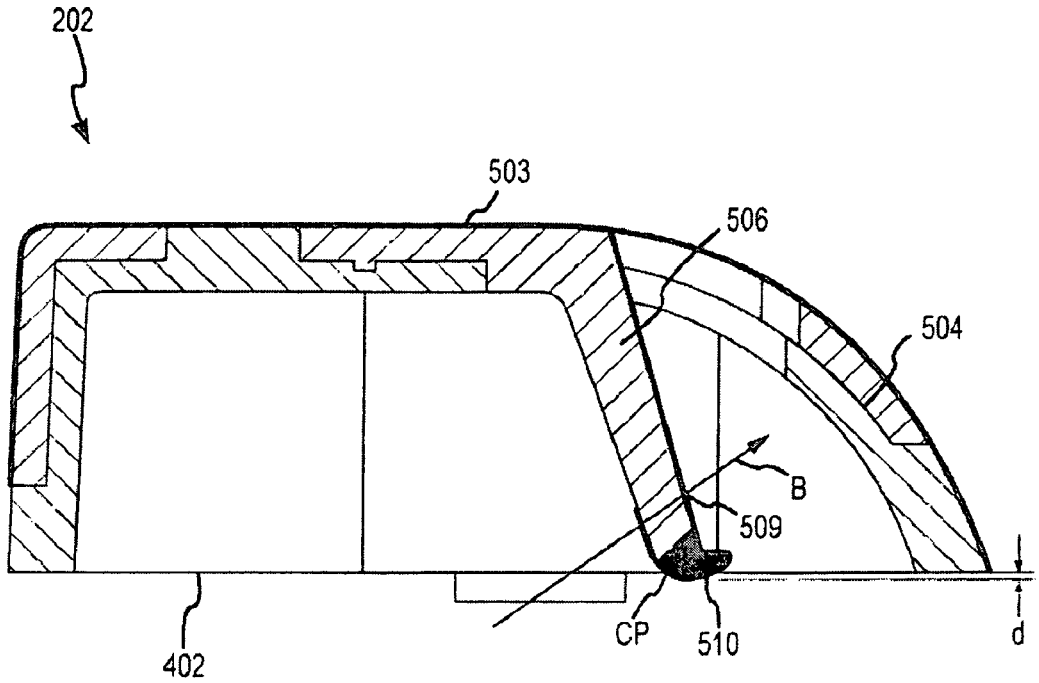
FIG. 5 is a cross sectional view of the antenna of FIG. 3.

Referring to FIG. 5, another cross-sectional view of antenna 202 and surface 402 is provided. In this case, antenna 202 includes a conductive layer 503 on a carriage 504. Carriage 504 also may be referred to as a base or carrier and may be constructed from molded plastic, laser direct structuring material, or the like as is known in the art. Antenna 202 includes molded beams 506. Molded beams 506 are provided with a conductive layer 509 terminating in contact point CP While numerous methods as are known in the art may be used to form antenna 202, one method includes providing a layer of conductive material 503, such as, for example, copper coupled to a non-conductive substrate 504. Non-conductive substrate may be a combination of platable and non-platable plastic, laser direct structuring material, or the like.

As can be seen by the cross sectional view in FIG. 5, conductive layer 509 extends over molded beams 506 to provide an electrical connection between conductive layer 503 and the electrical power supply connected to surface 402 at ground and power feed points 510. Conductive layer 509 and conductive layer 503 may be a single integrated conductive layer or separate, but connected, layers. Moreover, conductive layer 503 and conductive layer 509 may be the same or different conductive material.

As shown in FIG. 5, mounting antenna 202 on surface 402 causes molded beams 506 to deflect in the direction of arrow B a distance d. It has been found that in some instances this causes stress on the conductive layer 509 coupled to molded beams 506. The stress on conductive layer 509 may cause cracking and/or decreased effectiveness of the electrical connection between surface 402 and antenna 202.

Figure 6:
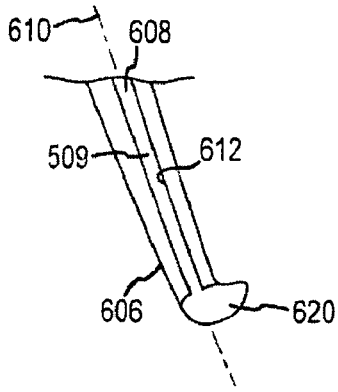
FIG. 6 is a cross section view of the molded beam of FIG. 5.
Figure 7:
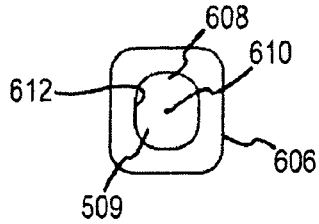
FIG. 7 is a top elevation view of the molded beam of FIG. 5.

Referring to FIG. 6, a cross sectional view of molded beams 606 is provided. Molded beams 606 are shown removed from antenna 202 for convenience. Molded beams 606 have a channel 608 extending through molded beams 606. As shown in FIG. 7, which is a top elevation view of molded beams 606, channel 608 is aligned with a geometric center line 610 of molded beams 606. However, channel 608 may be offset from the center line 610. Conductive layer 509 is coupled to the surface 612 of channel 608. Conductive layer 509 could be formed to leave a through channel along channel 608 or could be solid. As shown in FIG. 6, conductive layer 509 is terminates in a contact 620, which corresponds to contact point (CP) in FIGS. 4 and 5, and would be integrated to conductive layer 503 to provide an electrical connection. While conductive layer 509 and 503 may be separately stamped, plated, or the like, it is envisioned that the layers 509 and 503 would be plated as part of the same plating process making the layers 509 and 503 part of a single seamless conductive layer. Molded beams 606 may be constructed from laser direct structuring material such that surface 612 of channel 608 is activated by a laser to cause conductive layer 509 to couple to surface 612 during a plating process such as electroplating. Alternatively, molded beams 606 may be constructed from a two shot molding process with a platable plastic forming the surface 612 to which conductive layer 509 may be coupled using the plating process. Other means for coupling conductive layer 509 to surface 612 could be used as are generally known in the art. FIG. 7 shows a top plan view of molded beam 606 with channel 608.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An antenna assembly comprising:

a carrier;

at least one connector integrated into the carrier;

at least one channel having a surface, the channel extending through the at least one connector;

at least one first conductive layer coupled to the surface of the channel and terminating in a contact point adapted to couple to a radio frequency power source; wherein the at least one first conductive layer comprises the same or different material as the at least one second conductive material, and wherein the at least one first conductive layer is formed to leave a through channel extending through the at least one connector; and at least one second conductive layer selectively covering the carrier the at least one second conductive layer forming a radiating element, whereby the antenna assembly is configured to be operable such that radio frequency power is provided to the at least one second conductive layer from the radio frequency power source through the at least one first conductive layer.

2. The antenna assembly according to claim 1, wherein the at least one channel comprises:

a base layer comprising a first non-platable plastic; and a plating layer comprising a first platable plastic selectively formed on the base layer.

3. The antenna assembly according to claim 1, wherein the at least one channel is formed at a geometric center of the at least one connector.

4. The antenna assembly according to claim 1, wherein the carrier comprises:

a base layer comprising non platable plastic; and a platable layer comprising a platable plastic, wherein the base layer and the platable layer are formed using a two shot molding process.

5. An antenna assembly comprising:

a carriage;

at least one connector integrated into the carriage;

at least one channel having a surface extending through the at least one connector; wherein the surface comprises a laser direct structuring material;

at least one first conductive layer coupled to the surface and terminating in a contact point adapted to couple to a radio frequency power source; and at least one second conductive layer selectively covering the carriage, the at least one second conductive layer forming a radiating element, whereby the antenna assembly is operable such that radio frequency power is provided to the at least one second conductive layer from the radio frequency power source through the at least one first conductive layer.

6. An antenna assembly comprising:

a printed circuit board;

a base mounted on the printed circuit board;

at least one connector having a distal end and a proximate end, the at least one connector is integrated into the base at the proximate end;

each of the at least one connector having a channel, the channel extending through the at least one connector from the proximate end to the distal end, the channel having a surface;

a first conductive layer coupled to the base;

a second conductive layer coupled to the surface of the channel, the second conductive layer coupled to the first conductive layer and extending from the proximate end to the distal end and terminating in a first contact;

the printed circuit board having a second contact;

the first contact coupled to the second contact, wherein at least one electrical connection is formed between the printed circuit board and the first conductive layer by the second conductive layer.

7. The antenna assembly according to claim 6, wherein the at least one connector is deflected by the printed circuit board from an un-deflected position, and wherein the second conductive layer is formed to leave a through channel extending through the at least one connector.

8. The antenna assembly according to claim 6, wherein the channel is formed at a geometric center of the at least one connector.

9. The antenna assembly according to claim 6, wherein the channel comprises:

a non-platable plastic; and a platable plastic coupled to the non-platable plastic, wherein the second conductive layer is coupled to the platable plastic using a plating process.

10. An antenna assembly comprising:

a printed circuit board;

a base mounted on the printed circuit board;

at least one connector having a distal end and a proximate end, the at least one connector is integrated into the base at the proximate end;

each of the at least one connector having a channel, the channel extending from the proximate end to the distal end, the channel having a surface formed of a laser direct structuring material;

a first conductive layer coupled to the base;

a second conductive layer coupled to the surface of the channel, the second conductive layer coupled to the first conductive layer and extending from the proximate end to the distal end and terminating in a first contact;

the printed circuit board having a second contact;

the first contact coupled to the second contact, wherein at least one electrical connection is formed between the printed circuit board and the first conductive layer by the second conductive layer.

11. The antenna assembly according to claim 10, wherein the surface of the channel is formed by plating the second conductive layer to the laser direct structuring material.

12. An antenna assembly comprising:

an antenna;

a printed circuit board; and means integral to the antenna for providing an electrical connection between the antenna and the printed circuit board, wherein the means for providing an electrical connection comprises at least one connector having a surface formed of a laser direct structuring material; wherein at least one channel extends through the at least one connector, the at least one channel having the surface formed of a laser direct structuring material.

13. The antenna assembly according to claim 12, wherein the means for providing an electrical connection comprises at least one connector integral to the antenna having at least one channel.

14. The antenna assembly according to claim 13, wherein the at least one channel is formed at a geometric center of the at least one connector.

15. The antenna assembly according to claim 12, wherein the means for providing an electrical connection comprises at least one connector integral to the printed circuit board.

16. A method for forming an antenna comprising:

molding a base for an antenna adapted to mount on a printed circuit board, the base having at least one connector which includes a channel through the at least one connector;

plating at least a portion of the channel; and terminating the at least one connector with a contact point adapted to provide radio frequency power to the antenna from a circuit board to the antenna through the contact point and the channel; wherein the molding and plating comprises two shot molding selectively plating the antenna.

17. A method for forming an antenna comprising:

molding a carrier for an antenna adapted to mount on a printed circuit board, the carrier having at least one connector which includes a channel through the at least one connector;

plating at least a portion of the carrier and channel; and terminating the at least one connector with a contact point adapted to provide radio frequency power to the antenna from a circuit board to the antenna through the contact point and the channel;

wherein the molding and plating comprises a laser direct structuring material being selectively activated and plating the antenna.

* * * * *